US005478191A

United States Patent [19]

Rober

[11] Patent Number: 5,478,191

[45] Date of Patent: Dec. 26, 1995

[54] VEHICLE TILTING APPARATUS

[75] Inventor: Dennis J. Rober, Maumee, Ohio

[73] Assignee: Tilt-Tech Corp., Maumee, Ohio

[21] Appl. No.: 324,732

[22] Filed: Oct. 18, 1994

[51] Int. Cl.[6] ..... B63C 3/00

[52] U.S. Cl. ..... 414/678; 212/180; 254/3 B

[58] Field of Search ..... 414/678, 684, 414/743, 778, 779; 212/180; 254/3 R, 3 B

[56] References Cited

U.S. PATENT DOCUMENTS

| | | | |
|---|---|---|---|
| 1,915,024 | 6/1933 | Logette et al. . | |
| 2,567,672 | 9/1951 | Lawless | 214/1 |
| 3,428,191 | 2/1969 | Newswanger | 214/1 |
| 3,811,576 | 5/1974 | Fagen | 212/35 |
| 3,818,579 | 6/1974 | Pietrelli et al. | 29/559 |
| 3,838,783 | 10/1974 | Tune | 214/49 |
| 4,031,982 | 6/1977 | Lindfors | 187/8 |
| 4,134,501 | 1/1979 | Tune | 214/1 |
| 4,531,614 | 7/1985 | Naegeli | 187/8 |
| 4,700,851 | 10/1987 | Reeve et al. | 212/181 |
| 4,724,930 | 2/1988 | VanLierop | 187/8 |
| 4,966,517 | 10/1990 | Tune | 414/678 |
| 5,330,315 | 7/1994 | Beattie et al. | 414/678 |

FOREIGN PATENT DOCUMENTS

| | | | |
|---|---|---|---|
| 111388 | 8/1968 | Denmark . | |
| 1531125 | 8/1969 | Germany . | |
| 9416982 | 8/1994 | Sweden | 254/3 R |
| 933871 | 8/1963 | United Kingdom | 414/678 |

*Primary Examiner*—Michael S. Huppert
*Assistant Examiner*—Douglas A. Hess
*Attorney, Agent, or Firm*—Emch, Schaffer, Schaub & Porcello

[57] ABSTRACT

A vehicle tilting apparatus for rotating a vehicle for servicing or repair is disclosed. A support assembly is pivotally mounted on a base frame assembly. The support assembly includes a lifting assembly having a pair of spaced lift members. Support platforms for supporting the vehicle are pivotally mounted on one of the lift members. An over center locking assembly is mounted on the other lift member to releasably lock the support platform to the lift member.

14 Claims, 4 Drawing Sheets

VEHICLE TILTING APPARATUS

TECHNICAL FIELD

The present invention relates to the field of repairing or servicing equipment. In particular, the present invention is directed to a device for tilting or rotating a vehicle, such as a forklift, to facilitate repair or servicing.

BACKGROUND OF THE INVENTION

Devices are known in the art for moving a vehicle into a position which facilitates its repair or servicing. An example of such a prior art vehicle tilting apparatus is disclosed in U.S. Pat. No. 4,966,517 (Tune).

In prior art apparatus, the vehicle is positioned over a pair of support plates. After tilting of the vehicle to its desired position, it is necessary to move the support plates out of position to give the mechanic or repair man the ability to work on the vehicle. It has been found that the lifting procedure sometimes places forces on the support plate which makes it very difficult to unlock the support plates and move them out of position.

The present invention is directed to an improved vehicle tilting apparatus which includes an over center locking assembly for the support plates or support platforms which allows the operator to easily move the support plates or platforms away from the bottom of the vehicle.

SUMMARY OF THE INVENTION

The present invention is directed to a vehicle tilting apparatus which includes a base frame assembly and a support assembly pivotally mounted on the base frame assembly. The support assembly includes a lifting assembly having a pair of spaced lift members. At least one support platform is pivotally connected to one of the spaced pair of lift members. A vehicle is initially moved upon the support platform. The lift members are movable between a horizontal position and a vertical position, where repair or maintenance is performed. At least one over center locking assembly is mounted on the other one of the pair of spaced lift members to releasably lock said support platform to the other lift member.

It is the primary object of the present invention to provide an improved vehicle tilting apparatus in which the support plate or support platform can be easily pivoted out of the way by the use of an over center locking assembly.

DETAILED DESCRIPTION OF THE PREFERRED EMBODIMENT

Figure 1:
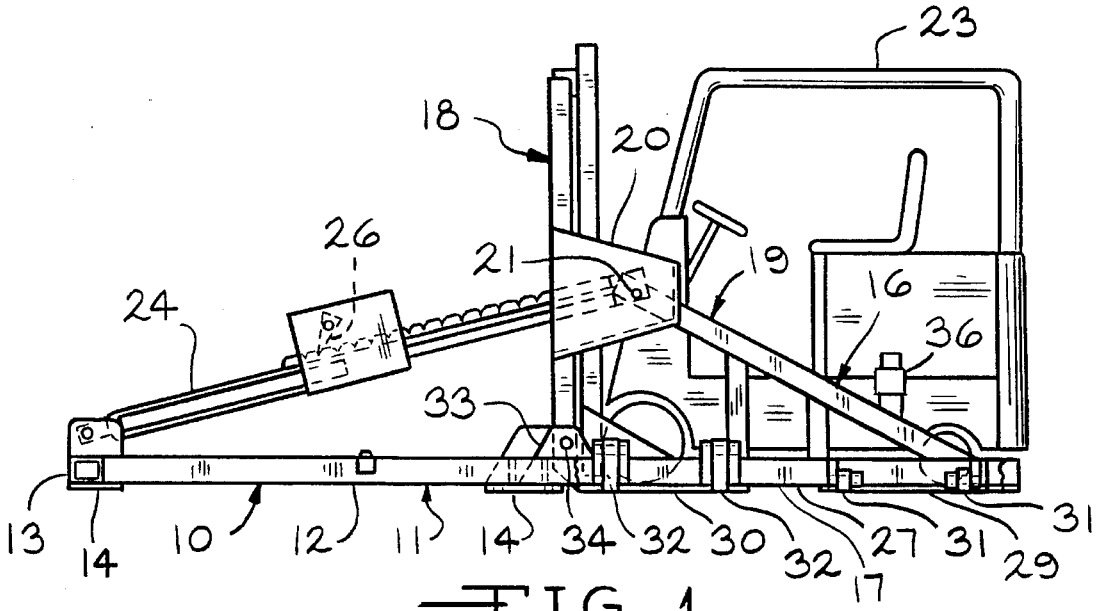
FIG. 1 is side elevational view of a vehicle tilting apparatus, in accordance with the present invention, and showing a forklift in a horizontal position.

A vehicle tilting apparatus, in accordance with the present invention, is generally indicated by the reference number 10. The tilting apparatus 10 includes a base frame assembly 11 having base side members 12, a base end member 13 and bottom connecting members 14. The base frame 11 can be moved into a predetermined position, for example on a concrete floor, where it is permanently connected to such floor. The tilting apparatus 10 also includes a support assembly 16 which includes a lifting assembly 17, a pivot assembly 18 mounted generally perpendicular to the lifting assembly 17 and a cross assembly 19 extending between the pivot assembly 18 and the lifting assembly 17. Gussets 20 are mounted on the pivot assembly 18. The cross assembly 19 is pivotally connected by pivot pins 21 to the gussets 20. The other end of the cross assembly 19 is connected to the lifting assembly 17. When the lifting assembly 17 is in its horizontal position, indicated in FIG. 1, a vehicle such as a forklift 23 can be moved onto the lifting assembly 17. Cylinders 24 extend between the base frame assembly 11 and the gussets 20 to provide lifting power to rotate the lifting assembly 17 from the horizontal position shown in FIG. 1 to the vertical position shown in FIG. 2. Preferably a rachet safety apparatus 26 is provided in case of failure of the cylinders 24.

The lifting assembly 17 includes a pair of spaced lift members 27 and at least one support platform. In the present embodiment, the lifting assembly 17 includes planar support panels or platforms 29 and 30. The support platform 29 is mounted by spaced hinges 31 to one of the lift members 27. The support platform 30 is hingedly mounted to the same lift member 27 by spaced hinges 32 (see FIG. 2).

Figure 2:
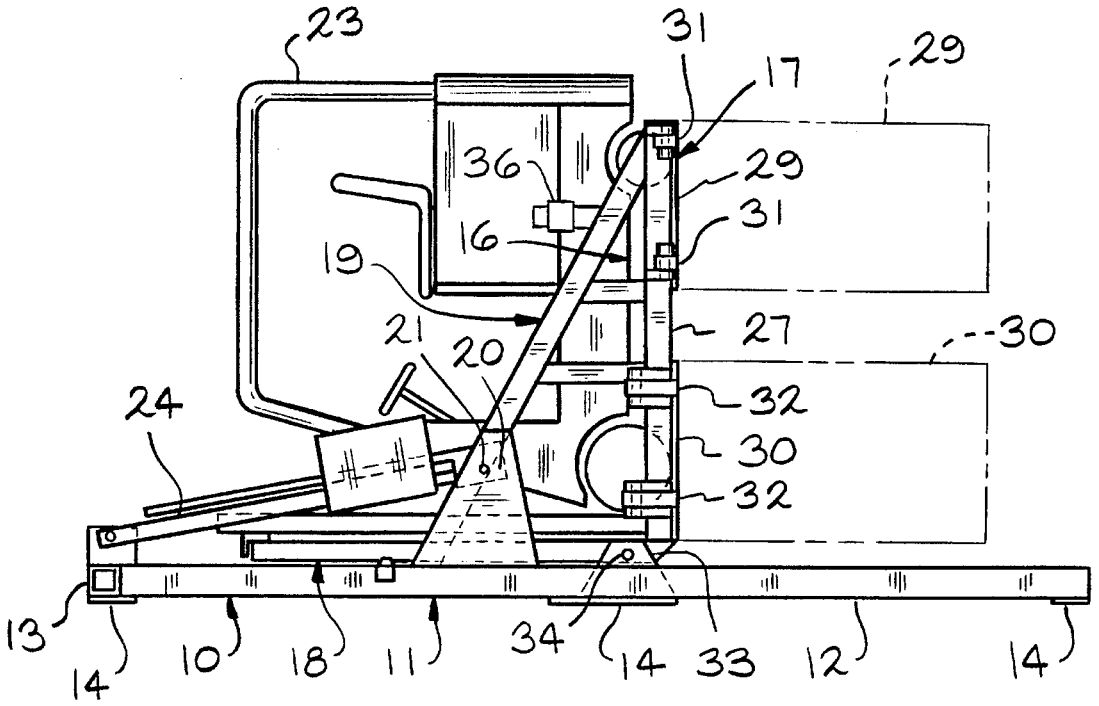
FIG. 2 is a side elevational view, similar to FIG. 1, showing the forklift after it has been tilted or rotated into a vertical position.

As best shown in FIG. 2, the overall lifting assembly 17 is pivotally connected to the base frame assembly I 1 by an opposed gusset assembly 33 which includes pivot pins 34. After a vehicle, such as the forklift 23, is moved onto the support platforms 29 and 30, as shown in FIG. 1, a hold down bar 36 (see FIG. 1)is secured. The lifting assembly 17 is then rotated ninety degrees to its generally vertical position shown in FIG. 2 by actuating the cylinders 24. It has been found that this movement over tends to place large locking forces upon any lock mechanisms for the support platforms 29 and 30.

Figure 3:
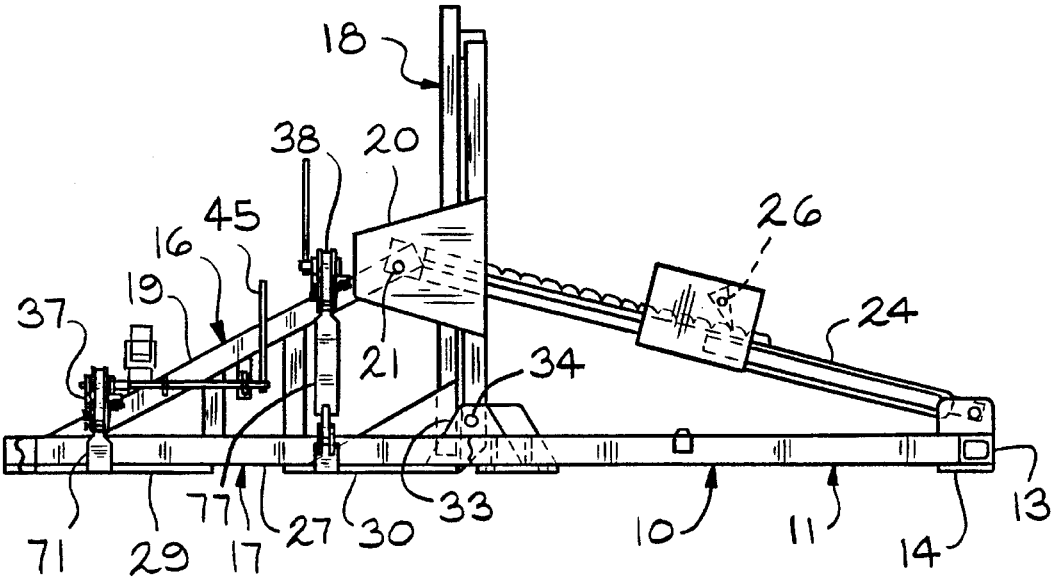
FIG. 3 is a side elevational view of the vehicle tilting apparatus, according to the present invention, showing the other side of the vehicle tilting apparatus, as compared to FIG. 1, with the forklift removed.

In the present invention, an important feature of the invention is an over center locking assembly which is positioned on the side of the support platforms 29 and 30. The over center locking assemblies are opposed to the hinge sets 31 and 32. Referring to FIG. 3, the support platform 29 is releasably connected to one of the spaced lift members 27 by an over center assembly 37. The support platform 30 is connected by an over center assembly 38. The over center assemblies 37 and 38 releasably lock the support platforms 29 and 30 to the lift member 27 for rotation of the vehicle 23 between the horizontal and vertical attitudes shown in FIGS. 1 and 2. The over center assembly 37 is shown in detail in FIGS. 5 and 6. A support 40 is welded or otherwise fixed to the spaced lift member 27. The over center assembly 37 is mounted on the support 40 by sets of machine screws 41 and 42 (see FIG. 5). The screws 41 mount a pair of bearing brackets 43 which in turn mount a rotatable shaft 44. Preferably a handle 45 is positioned at the end of the shaft 44 to provide sufficient leverage to turn the rotatable shaft 44.

A pair of spaced over center links 47 have one end 48 fixed to the rotatable shaft 44 and a second pivot end 49. A pivot shaft 50 extends between the second pivot ends 49 of the over center links 47. A curved lift arm 52 has a first end 53 and a second end 54. The first end 53 of the curved lift arm 52 is pivotally mounted by the pivot shaft 50 to the pivot ends 49 of the over center links 47.

Figure 5:
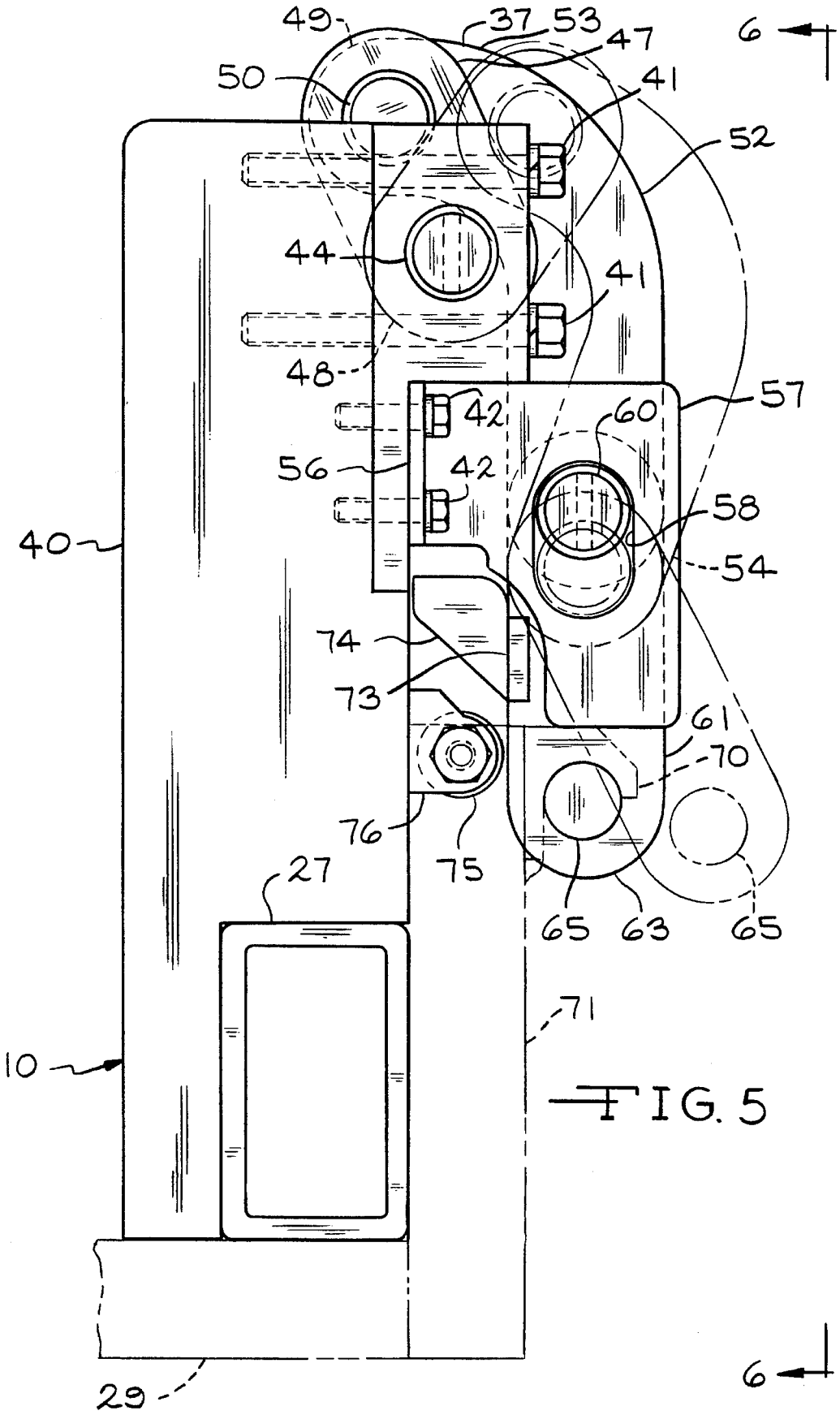
FIG. 5 is an enlarged sectional view showing the over center locking assembly, according to the present invention, in a solid line locked position and indicating by dashed lines the unlocked position.
Figure 6:
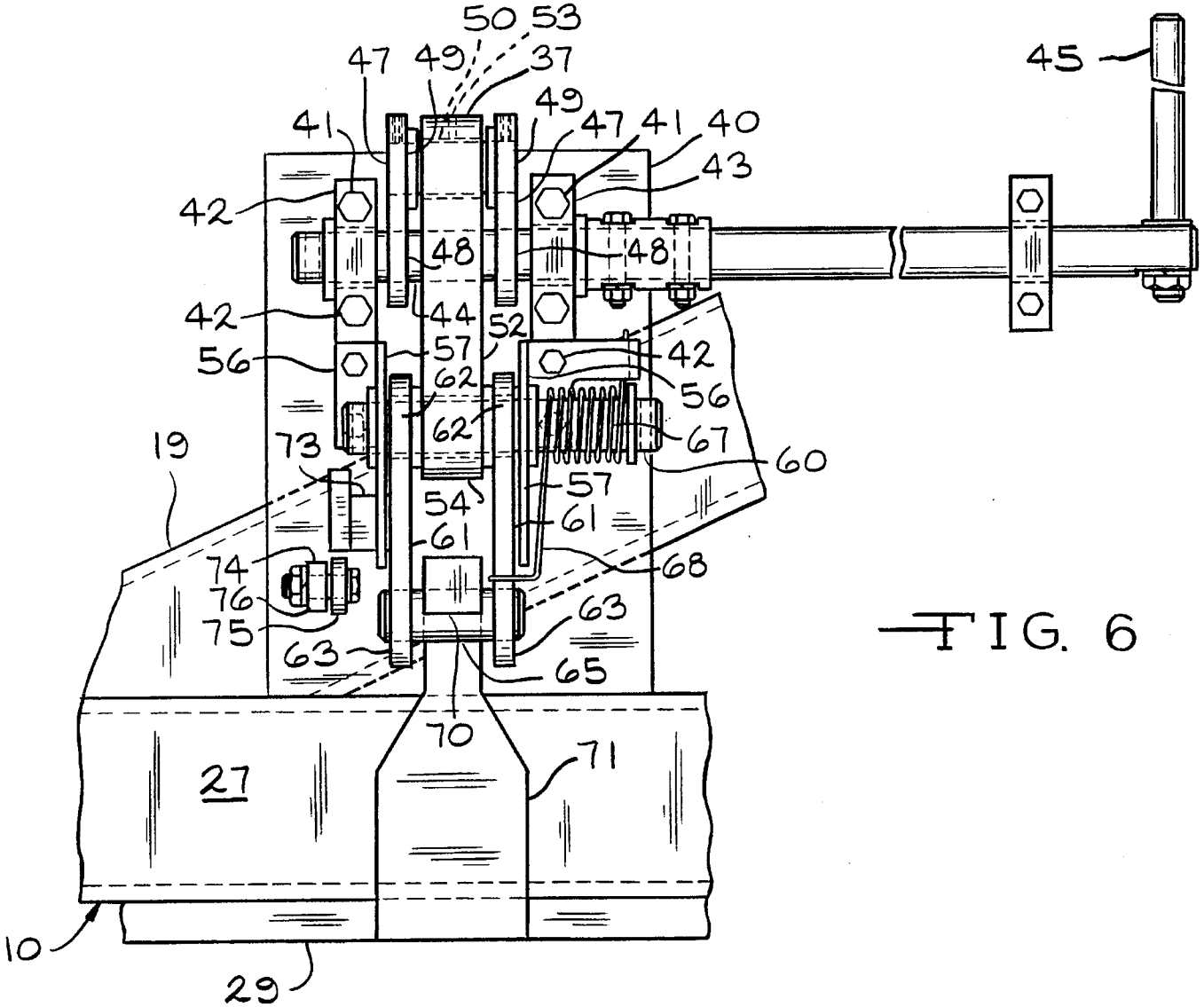
FIG. 6 is a fragmentary elevational view taken alone the line 6—6 of FIG. 5 and showing the over center locking assembly in its locked position.

Referring to FIGS. 5 and 6, the machine screws 42 mount a pair of opposed guide brackets 56. The guide brackets 56 include a pair of spaced support plates 57 which define opposed guide slots 58. The guide slots 58 define a predetermined path.

Referring to FIG. 6, the second end 54 of the curved lift arm 52 is pivotally mounted on a pivot pin 60. The pivot pin 60 extends through and is guided by the guide slots 58 defined by the support plates 57 of the opposed guide brackets 56. A pair of locking links 61 have upper ends 62 which are pivotally mounted on the pivot pins 60 adjacent the second end 54 of the lift arm 52. In the present embodiment, the lower ends 63 of the locking link 61 mount a first locking member, which in the current embodiment is a lock pin 65.

Referring to FIG. 6, in the present embodiment, a spring 67 is mounted on the pivot pin 60 and includes a spring member 68 which is mounted adjacent the lower end 63 of one of the locking links 61. The spring 67 and the spring member 68 urge the lock pin 65 inwardly toward a locked position.

in the present embodiment, the lock pin 65 serves as the first locking member and a second locking member comprises an engaging hook 70, which is operatively connected to the support platform 29. It should be noted that the first and second locking members 65 and 70 may be interchanged or have different configurations. The spring 67 urges the lock pin 65 into its locked position with the engaging hook 70.

A latch member 71 has a narrowed portion which, in the present embodiment, defines the engaging hook 70 at its upper end (see FIG. 6). The lower end of the latch member 71 is operatively connected to the respective one of the spaced lift members 27. In the embodiment shown in FIG. 6, the latch member 71 is welded to or otherwise suitably connected to the support platform 29.

Referring to FIGS. 5 and 6, in the present embodiment, a cam bracket 73 is mounted on one of the locking links 61. The cam bracket 73 defines a cam surface 74. A cam roller 75 is mounted by a bracket 76 to the support 40 (see FIG. 5). Upon vertical downward movement of the locking links 61, the cam surface 74 engages the cam roller 75 and the lock pin 65 is cammed outwardly from its locked position with the engaging hook 70 to the unlocked position indicated by the dashed line position shown in FIG. 5.

Referring to FIG. 3, the over center assembly 38 which releasable locks the support platform 30 is similar to the over center assembly 37, described above, with the exception that its latch member 77 is elongated and is connected to the support platform 30 by a hinge assembly 78.

In a typical operation of the vehicle tilting apparatus 10, according to the present invention, the support platforms 29 and 30 are in their locked position and are moved to a horizontal downward position such that the support platforms 29 and 30 are adjacent the base frame assembly 11. The vehicle 23 is placed upon the support plates 29 and 30 and the hold down bar 36 is moved into position. The cylinders 24 are then actuated moving the spaced lift members 27 through a ninety degree rotation such that the vehicle 23 is tilted upwardly to the FIG. 2 position. To release the support platform 29, the operator grasps the handle 45 and rotates the shaft 44. The over center links 47 are rotated outwardly. After the curved lift arm 52 passes the over center position, the force required is substantially lessened. The pivot pin 60 mounted at the lower end of the lift arm 52 is guided along the guide slots 58. At this time, the spring 67 is urging the lock pin 65 into engagement with the engaging hook 70 of the latch member 71. The over center assembly 37 provides a mechanical advantage which allows substantial force to be applied by the operator to release the support platform 29. The cam surface 74 engages the cam roller 75 and the lock pin 65 is moved outwardly away from its locked position with the engaging hook 70 to the unlocked position indicated in dashed line.

Figure 4:
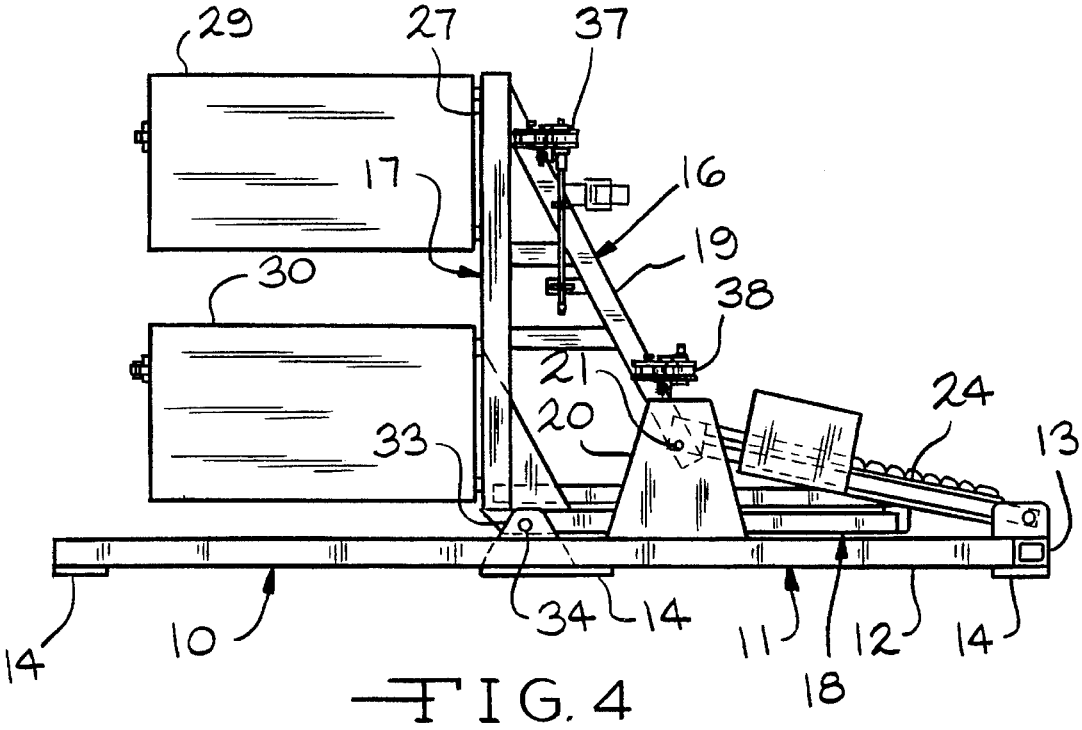
FIG. 4 is a view similar to FIG. 3 with the lifting assembly moved to a vertical position and showing the support platforms pivoted outwardly into their unlocked position.

The over center assembly 38 is operated in a similar manner. After both of the over center assemblies 37 and 38 are released, the support platforms 29 and 30 are swung outwardly, as indicated in FIG. 4. The operator is then free to service or repair the vehicle. After repair, the support platforms 29 and 30 are placed in their locked positions. The lifting assembly 17 is moved downwardly to its horizontal position adjacent the base frame assembly 11 and the vehicle may be removed. The vehicle tilting apparatus 10 is then ready for the next cycle.

Many revisions may be made to the above described preferred embodiment without departing from the scope of the present invention or from the following claims.

I claim:

1. A vehicle tilting apparatus, comprising a base frame assembly, a support assembly pivotally mounted on said base frame assembly, said support assembly including a lifting assembly having a pair of spaced lift members and at least one support platform pivotally connected to one of said pair of spaced lift members, wherein a vehicle can be received on said support platform, said lift members being movable between a horizontal position and a vertical position, and at least one over center locking assembly mounted on the other one of said pair of spaced lift members to releasably lock said support platform to said lift member, said over center locking assembly including a rotatable shaft, at least one over center link having one end fixed to said rotatable shaft and a second pivot end, a curved lift arm having first and second ends, said first end of said lift arm pivotably mounted to said pivot end of said over center link and at least one locking link pivotally mounted on said second end of said lift arm, said locking link mounting a first lock member and a second lock member operatively mounted on said support platform, wherein said over center locking assembly moves said first and second lock members between a locked position and an unlocked position.

2. A vehicle tilting apparatus, according to claim 1, including a cam assembly for urging said first lock member away from its locked position with said second lock member.

3. A vehicle tilting apparatus, according to claim 2, wherein said cam assembly includes a cam bracket extending outwardly from said locking link, said cam bracket defining a cam surface and a cam roller mounted adjacent said cam bracket, whereby upon movement of said locking link said cam surface engages said cam roller and urges said first lock member away from its locked position.

4. A vehicle tilting apparatus, according to claim 3 wherein said first lock member comprises a locking pin and said second lock member comprises an engaging hook.

5. A vehicle tilting apparatus, according to claim 1, including guide means for moving said second end of said curved lift arm along a predetermined path.

6. A vehicle tilting apparatus, according to claim 5, wherein said guide means for moving include a pair of spaced support plates, said support plates defining guide slots, and a pivot pin pivotally mounting said curved lift arm and said locking link.

7. A vehicle tilting apparatus, according to claim 1, including spring means for urging said first and second lock members into such locked position.

8. A vehicle tilting apparatus, according to claim 4, including a latch member operatively connected to said support platform, said latch member defining said engaging hook adjacent its upper end.

9. A vehicle tilting apparatus, according to claim 8, including a hinge assembly mounted between said latch member and said support platform.

10. A vehicle tilting apparatus, according to claim 1, wherein said support assembly includes a pivot assembly mounted generally perpendicular to said lifting assembly and a cross assembly extending between said pivot assembly and said lifting assembly and cylinders operatively connected between said base frame assembly and said support assembly for rotating said lifting assembly between a horizontal position and a vertical position.

11. A vehicle tilting apparatus, comprising a base frame assembly, a support assembly pivotally mounted on said base frame assembly, said support assembly including a lifting assembly having a pair of spaced lift members and a pair of spaced support platforms pivotally connected to one of said pair of spaced lift members, cylinder means operatively connected between said base frame and said lifting assembly for moving said lift members between a horizontal position and a vertical position and an over center locking assembly mounted adjacent one of said spaced lift members adjacent each of said support platforms, each of said over center locking assembly including bearing means for supporting a shaft, a rotatable shaft mounted by said bearing means, a pair of spaced over center links having first ends fixed to said rotatable shaft and pivot ends, a curved lift arm having first and second ends, said curved lift arm being positioned between said spaced over center links, said first end of said curved lift arm being pivotally mounted to said pivot ends of said over center links, a pivot pin mounted on said second end of said lift arm, a pair of locking links pivotally mounted on said pivot pin adjacent said lift arm, guide means for moving said pivot pin in a predetermined path, a locking pin extending between said locking links, and a latch member operatively connected to one of said support platforms, said latch member defining an engaging hook, wherein said over center locking assembly moves said locking pin and said engaging hook between a locked position and an unlocked position.

12. A vehicle tilting apparatus, according to claim 11, including a cam assembly for guiding said locking pin away from said engaging hook.

13. A vehicle tilting apparatus, according to claim 11, including spring means for urging said locking pin and said engaging hook into such locked position.

14. A vehicle tilting apparatus, according to claim 11, including a handle extending outwardly from said rotatable shaft.

* * * * *